US007055632B2

(12) United States Patent
Dallas

(10) Patent No.: US 7,055,632 B2
(45) Date of Patent: Jun. 6, 2006

(54) WELL STIMULATION TOOL AND METHOD FOR INSERTING A BACKPRESSURE PLUG THROUGH A MANDREL OF THE TOOL

(75) Inventor: L. Murray Dallas, Fairview, TX (US)

(73) Assignee: H W C Energy Services, Inc., Houston, TX (US)

( * ) Notice: Subject to any disclaimer, the term of this patent is extended or adjusted under 35 U.S.C. 154(b) by 242 days.

(21) Appl. No.: 10/683,743

(22) Filed: Oct. 10, 2003

(65) Prior Publication Data

US 2005/0077043 A1 Apr. 14, 2005

(51) Int. Cl.
*E21B 33/68* (2006.01)

(52) U.S. Cl. ..... 175/382; 175/387; 175/75.14; 175/85.3

(58) Field of Classification Search ..... 166/382, 166/387, 77.51, 75.14, 85.3, 95.1, 332.5
See application file for complete search history.

(56) References Cited

U.S. PATENT DOCUMENTS

| | | | | |
|---|---|---|---|---|
| 2,233,077 | A * | 2/1941 | Gillespie et al. | 166/67 |
| 2,830,666 | A * | 4/1958 | Rhodes | 166/97.1 |
| 5,020,590 | A | 6/1991 | McLeod | 166/77 |
| 5,103,900 | A | 4/1992 | McLeod et al. | 166/88 |
| 5,785,121 | A | 7/1998 | Dallas | 166/90.1 |
| 5,819,851 | A | 10/1998 | Dallas | 166/308 |
| 5,927,403 | A | 7/1999 | Dallas | 166/77.51 |
| 6,220,363 | B1 * | 4/2001 | Dallas | 166/382 |
| 6,289,993 | B1 | 9/2001 | Dallas | 166/386 |
| 6,364,024 | B1 | 4/2002 | Dallas | 166/379 |
| 6,595,297 | B1 | 7/2003 | Dallas | 166/382 |
| 6,626,245 | B1 | 9/2003 | Dallas | 166/379 |
| 6,817,421 | B1 | 11/2004 | Dallas | 166/379 |
| 6,817,423 | B1 | 11/2004 | Dallas | 166/382 |
| 6,918,439 | B1 * | 7/2005 | Dallas | 166/85.3 |
| 6,938,696 | B1 | 9/2005 | Dallas | 166/377 |
| 2003/0116314 | A1 | 6/2003 | Dallas | |
| 2004/0231856 | A1 | 11/2004 | Dallas et al. | 166/379 |
| 2004/0262012 | A1 | 12/2004 | McGuire et al. | 166/370 |
| 2005/0006103 | A1 | 1/2005 | McGuire et al. | 166/379 |

* cited by examiner

*Primary Examiner*—William Neuder
(74) *Attorney, Agent, or Firm*—Nelson Mullins Riley & Scarborough, LLP

(57) ABSTRACT

A well stimulation tool includes a well stimulation tool mandrel with an axial bore having an internal diameter large enough to permit a backpressure plug to be run through the mandrel into a tubing mandrel, such as a tubing hanger or a casing mandrel, to which the well stimulation tool mandrel is secured. This permits well stimulation to be performed through a tubing string suspended in the well by the tubing mandrel, without requiring wireline services.

20 Claims, 9 Drawing Sheets

WELL STIMULATION TOOL AND METHOD FOR INSERTING A BACKPRESSURE PLUG THROUGH A MANDREL OF THE TOOL

CROSS-REFERENCE TO RELATED APPLICATIONS

This is the first application filed for the present invention.

MICROFICHE APPENDIX

Not Applicable.

TECHNICAL FIELD

The invention relates to the stimulation of oil and gas wells to improve production and, in particular, to a well stimulation tool used to deliver high-pressure fluids through a production tubing string of a well in order to acidize and/or fracture subterranean formations with which the well communicates.

BACKGROUND OF THE INVENTION

It is well known that many oil and gas wells require stimulation in order to increase production either as part of well completion, or as part of well work-over. Well stimulation involves the pumping of proppants and fluids under high pressure into the annulus of the well in order to break up subterranean formations and release hydrocarbons into the wellbore, where they can be extracted to the surface. Since it is generally not economically feasible to manufacture wellhead equipment that can withstand extreme pressures, the wellhead must be isolated or removed during well stimulation in order to prevent potential damage and/or injury.

In is well known that it is advantageous to stimulate certain wells, especially gas wells through a production tubing of the well. This permits the well to be stimulated without removing the production tubing from the well, which saves considerable time and reduces service fees.

It is well known that these well stimulation procedures can be performed by connecting a well stimulation tool mandrel to a top of a tubing hanger that supports the production tubing in the well. Before the well stimulation tool mandrel can be connected to the top of the tubing hanger, natural pressure in the well must be contained to prevent the escape of hydrocarbons to atmosphere. Well pressure containment is accomplished in one of two well known ways. First, the well may be "killed" by pumping an overbearing fluid into the well. Killing the well is, however, generally not desirable for a number of reasons. First, the operation is generally expensive and second, the production zones may be plugged or damaged by the overbearing fluid. A second method more commonly used is to seal the production tubing prior to removing a wellhead control stack. The production tubing is sealed using a wireline lubricator to insert a wireline plug into the production tubing string below the tubing hanger. Once the tubing is sealed, the wellhead control stack can be removed from the well and the well stimulation tool can be mounted directly or indirectly to the top of a tubing head spool that supports the tubing hanger. The well stimulation tool mandrel is then screwed into box threads in a top end of an axial passage through the tubing hanger, in a manner well known in the art.

After the well stimulation tool is mounted to the tubing hanger, the wireline plug in the production tubing must be removed to permit the well stimulation procedure to commence. Consequently, the wireline lubricator is used to run in the wireline and retrieve the wireline plug. Thereafter, high pressure lines are connected to the well stimulation tool and high pressure fluids are pumped into the well to acidize or fracture the hydrocarbon producing zones(s).

After the well has been stimulated and the stimulation fluids flowed back out of the well, the production tubing must be sealed again to permit the well stimulation tool to be removed from the tubing head spool. Consequently, the wireline unit must be brought back to the job site, and the wireline lubricator mounted to the top of the well stimulation tool. The wireline is run in to set the wireline plug in the production tubing string. The well stimulation tool can then be safely removed and the wellhead control stack re-mounted to the tubing head spool. After the wellhead control stack is remounted to the tubing head spool, the wireline must be run in again to retrieve the plug before the production of hydrocarbon can be recommenced.

As is well understood by those skilled in the art, wireline services are expensive and time consuming.

There therefore exists a need for a simpler and more economical method and apparatus for stimulating wells using a well stimulation tool mandrel connected to a top of the tubing hanger in a live well.

SUMMARY OF THE INVENTION

It is therefore an object of the present invention to provide a well stimulation tool and a method of stimulating wells using a well stimulation tool mandrel connected to a top of a tubing mandrel in a live well It is a further object of the invention to provide a method of inserting a backpressure plug wherein the backpressure plug can be run through the well stimulation tool mandrel and secured to the backpressure threads in the tubing mandrel.

The well stimulation tool is used to stimulate a well having a tubing mandrel that supports a tubing string suspended from the tubing mandrel in a wellhead. The well stimulation tool includes a well stimulation tool mandrel having an annular body defining a mandrel bore, a top flange for connecting to a high-pressure valve and bottom threads for connecting to an adapter pin, the mandrel bore having a diameter larger than an outer diameter of a backpressure plug for plugging a central passage through the tubing mandrel to contain well pressure within the tubing string.

Preferably, the adapter pin has an annular body defining an adapter pin bore, upper threads for connecting to the well stimulation tool mandrel and lower threads for connecting to the tubing mandrel, the adapter pin bore having a diameter greater than the outer diameter of the backpressure plug permitting the backpressure plug to be inserted through the adapter pin bore and to be secured to the tubing mandrel.

The invention further provides a method of removing a well stimulation tool from a tubing hanger of a live well. The method includes the steps of inserting a tubing string of the well by inserting a backpressure plug tool through a well stimulation tool mandrel of the well stimulation tool, and sealing a central passage through the tubing mandrel using a backpressure plug to prevent an escape of well fluids to atmosphere when the well stimulation tool is removed.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

The invention provides a well stimulation tool and method of using the well stimulation tool to permit a live well to be stimulated through a tubing string of the well, without using wireline services to seal the tubing string while various above-ground components required before, during and after the well stimulation procedure are changed. The well stimulation tool includes a well stimulation tool mandrel having an axial bore with a diameter large enough to permit a backpressure plug to be inserted into a tubing mandrel that supports the tubing string. This permits a live well to be stimulated without using wireline services to seal the tubing string, as has been required in the past. As used in this document, the phrase "tubing string" means any production casing or production tubing suspended within a production casing, and "tubing mandrel" means any mandrel adapted to support a tubing string in a live well, including any tubing hanger and any casing mandrel having an axial passage that includes backpressure threads for retaining a backpressure plug.

Figure 1:
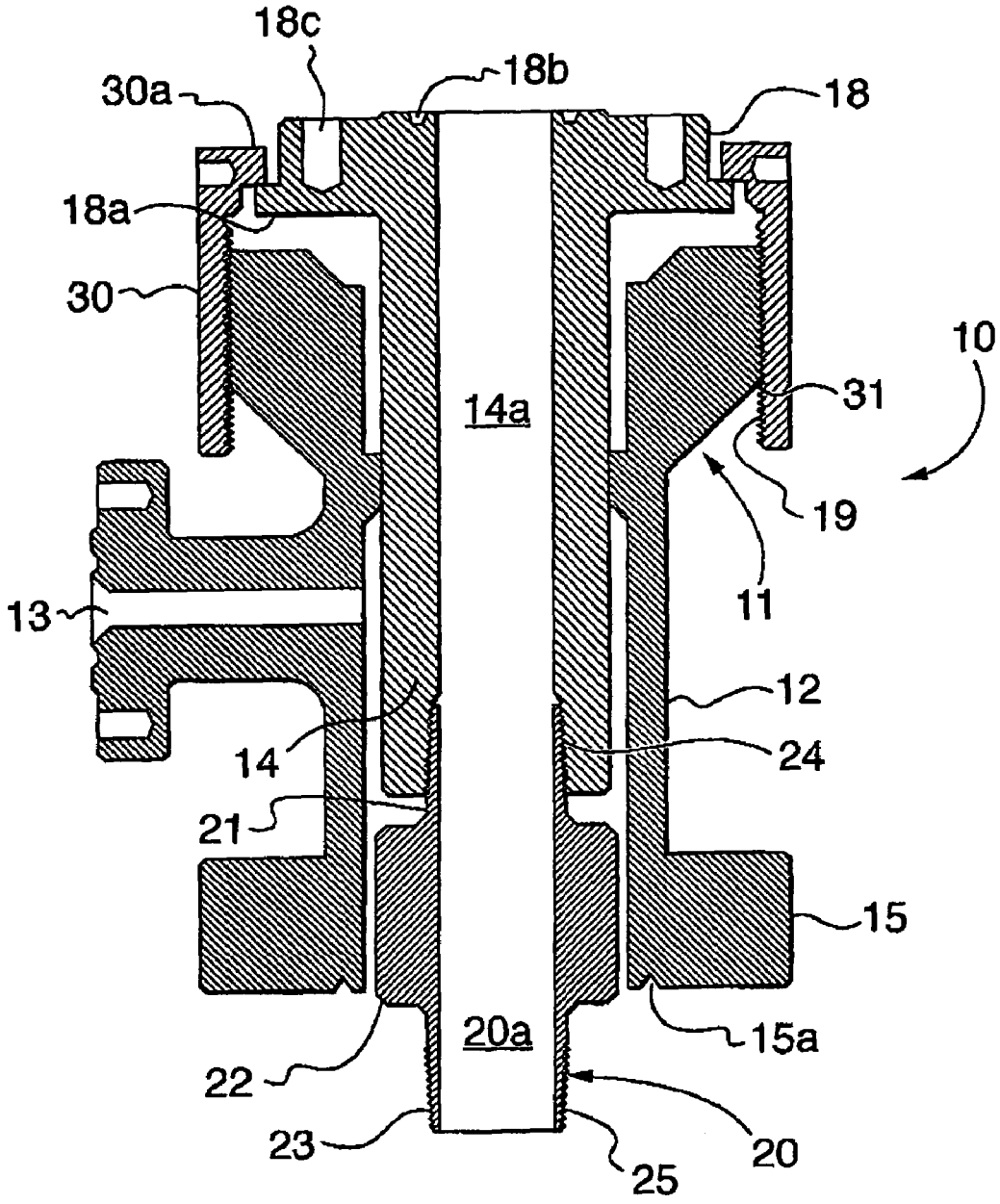
FIG. 1 is a cross-sectional view of a well stimulation tool in accordance with a first embodiment of the present invention.

As illustrated in FIG. 1, a well stimulation tool 10 in accordance with the invention includes an adapter spool 12, which is a generally annular body with a central bore into which a mandrel 14 is received. The adapter spool 12 has a side port 13 for flow-back or pressure testing. The adapter spool 12 further includes a bottom flange 15 adapted for connection to either a tubing head spool or a blowout preventer (neither of which are shown in FIG. 1, but both of which are well known in the art). When the bottom flange 15 of the adapter spool 12 is mounted to a blowout preventer, the blowout preventer is in turn mounted to the tubing head spool. The bottom flange 15 also has an annular groove 15*a* that receives an O-ring, which forms a fluid-tight seal between the bottom flange 15 and a top flange of either the tubing head spool or the blowout preventer.

A top end 11 of the adapter spool 12 has external threads 31 for engagement with corresponding internal threads 19 on a lockdown nut 30 to secure the mandrel 14 to the adapter spool 12. The lockdown nut 30 secures the mandrel 14 to the adapter spool 12 by virtue of a downwardly facing annular shoulder 30*a* of the lockdown nut 30, which abuts and forces downwardly on an upwardly facing annular shoulder 18*a* of a top flange 18 of the mandrel 14.

The mandrel 14 is a generally annular body having an axial bore 14*a*. The top flange 18 of the mandrel may be connected to a high-pressure valve 64 (see FIG. 7). The top flange 18 of the mandrel has an annular groove 18*b* for receiving a ring gasket (not shown) for forming a fluid-tight seal with the bottom flange of the high-pressure valve 64. The top flange 18 further includes bores 18*c* which are threaded for receiving studs used to secure the high-pressure valve 64.

The mandrel 14 also has a bottom end with threads for direct connection to a tubing hanger, or for indirect connection to the tubing hanger via an adapter pin 20. In the illustrated embodiment, mandrels rated for sour well service (i.e. wells with high concentrations of sulfur dioxide and sulfite) have internal threads for receiving the adapter pin 20. For sweet well service (i.e. wells with low concentrations of sulfur dioxide and sulfite), the threads are external. This is a matter of design choice and is provided so that a sweet service mandrel 14 or adapter pin 20 is not mistakenly used when sour service equipment is required. As will be understood by those skilled in the art, this convention need not be adapted and has no bearing on the function of the well stimulation tools in accordance with the invention.

The adapter pin 20 is an annular body with an axial bore 20*a*. The adapter pin 20 has a set of upper pin threads 24 for connection to the mandrel 14, and a set of lower pin threads 25 for connection to a tubing hanger. As shown in FIG. 1, the adapter pin 20 has a thin-walled upper portion 21, a thick-walled central portion 22 and a thin-walled lower portion 23. The axial bore 20*a* is machined to the same diameter as the mandrel bore 14a as illustrated in FIG. 1. The mandrel 14 and the adapter pin bore 20 have an internal diameter that permits a backpressure plug to be inserted through the well stimulation tool into the tubing hanger. For example, a standard 3½-inch production tubing typically has an internal diameter of about 2.992 inches. A backpressure plug for a tubing hanger for that production tubing typically has an outer diameter of about 3.025 inches. The bore of the adapter pin for the 3½-inch tubing must therefore be machined to a nominal inner diameter of about 3.040 inches, which provides a tolerance of about 0.015 inches to ensure that the backpressure plug will not lodge in the axial bores of the mandrel and the adapter pin as it is inserted into the tubing hanger or withdrawn from the tubing hanger.

In order for the adapter pin 20 to withstand the high fluid pressure to which it is subjected during fracturing, the adapter pin must be constructed using steel having a Rockwell C Hardness proportional to the required pressure rating of the mandrel. Where the required pressure rating of the mandrel is in the neighborhood of 15,000 psi, the adapter pin is made of steel having a Rockwell C Hardness of at least 30.

For sour gas wells, where sulfur compounds react with water to form highly corrosive sulfuric acid, the adapter pin should be constructed using corrosion-resistant steel such as stainless steel. Where both corrosion resistance and high pressure resistance are required, the adapter pin may be made of HH1150 NACE Trim Stainless Steel (standardized by the National Association of Corrosion Engineers) which has a Rockwell C Hardness of 30 to 32.

Figure 2:
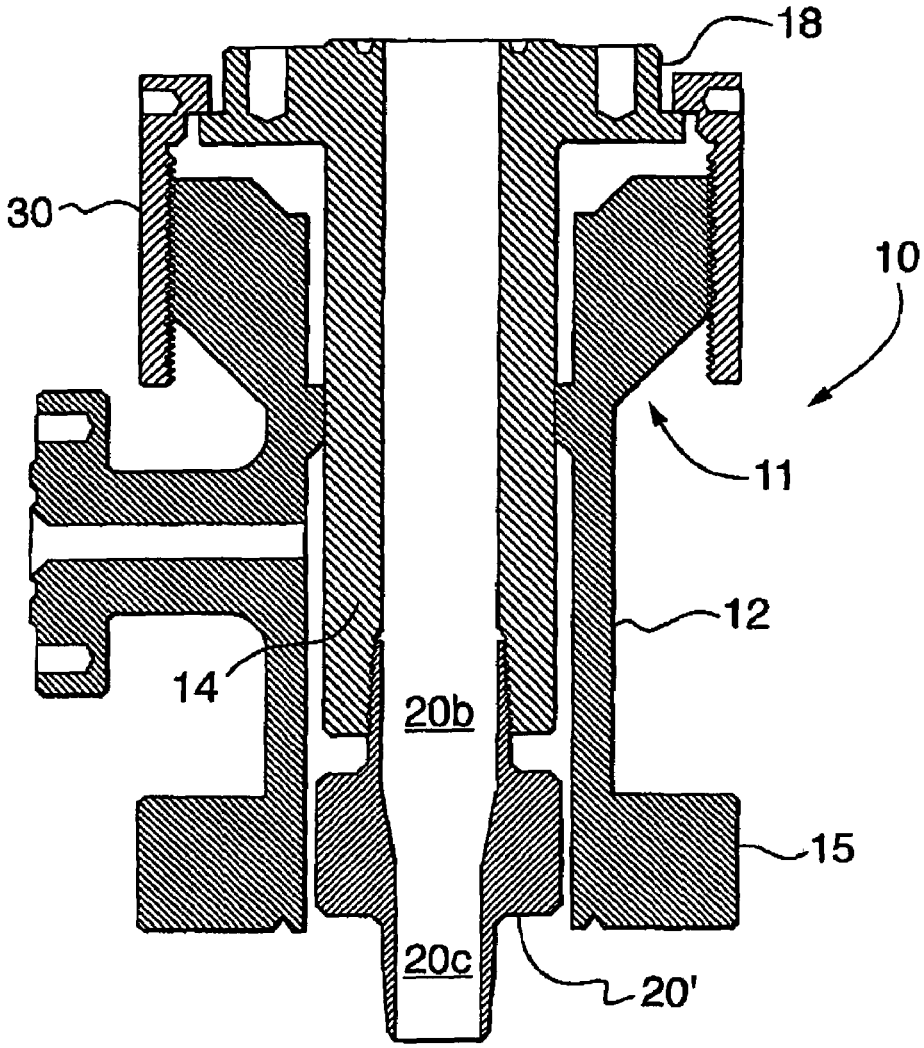
FIG. 2 is a cross-sectional view of a well stimulation tool in accordance with a second embodiment of the present invention.

As shown in FIG. 2, a crossover adapter pin 20' may be used to adapt to a tubing hanger for a production tubing of a different diameter. Standard production tubing usually comes with outer diameters of 2⅜ inches, 2⅞ inches or 3½ inches. A crossover adapter 20' thus permits attachment of the well stimulation tool 10 to a tubing hanger for supporting production tubing of any size. The crossover adapter 20' has a full bore section 20*b* and a reduced bore section 20*c*. The full bore section 20*b* is machined to the same diameter as the mandrel bore 14*a*, whereas the reduced bore section 20*c* is machined to permit the insertion of a backpressure plug into the tubing hanger with which the adapter pin is sized to connect. Consequently, the section 20*c* of the adapter pin 20' has a diameter at a narrowest point that is greater than an outer diameter of a backpressure plug for the tubing hanger to which the adapter pin is connected, thus permitting the backpressure plug to be reciprocated therethrough.

Figure 3:
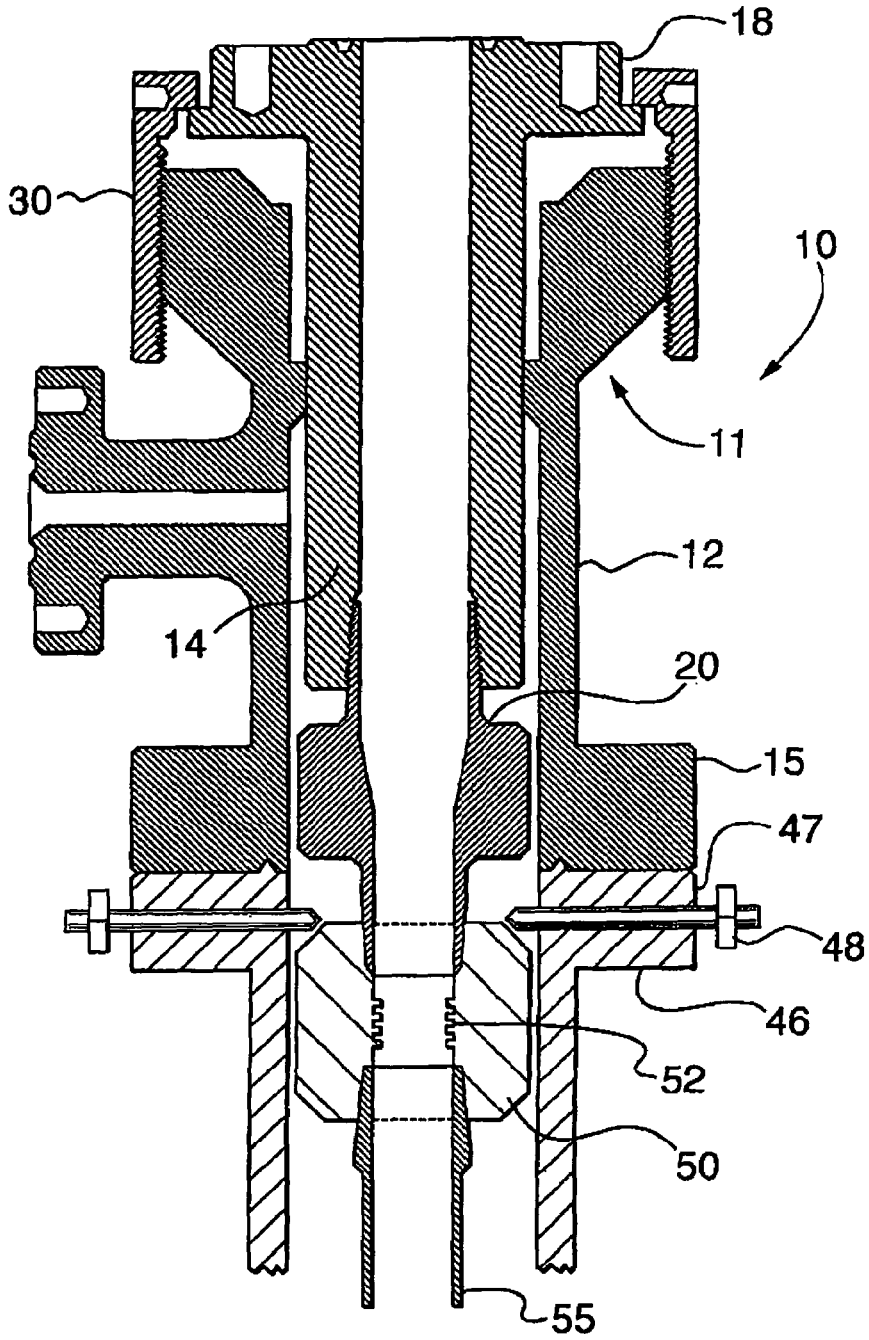
FIG. 3 is a schematic cross-sectional view of the well stimulation tool shown in FIG. 2 mounted atop a tubing head spool and secured to a tubing hanger.

FIG. 3 illustrates the well stimulation tool 10 shown in FIG. 2 mounted atop a tubing head spool 46. The lower flange 15 of the adapter spool 12 sits atop an upper flange 47 of the tubing head spool 46. Lock pins 48 are located in radial bores in the upper flange of the tubing head spool 46. The lock pins 48 retain a tubing hanger 50 by engaging an upper beveled surface of the tubing hanger as shown in FIG. 3 in a manner known in the art. Secured to an underside of the tubing hanger 50 is a production tubing string 55. The tubing hanger 50 has a central passage with an upper box thread for threaded engagement with a landing joint (not shown) or the adapter pin 20,20'. The tubing hanger 50 also has a lower box thread for supporting the production tubing 55. The tubing hanger 50 further includes backpressure threads 52 adapted to threadedly engage external threads of a backpressure plug 100 (see FIG. 4).

Figure 4:
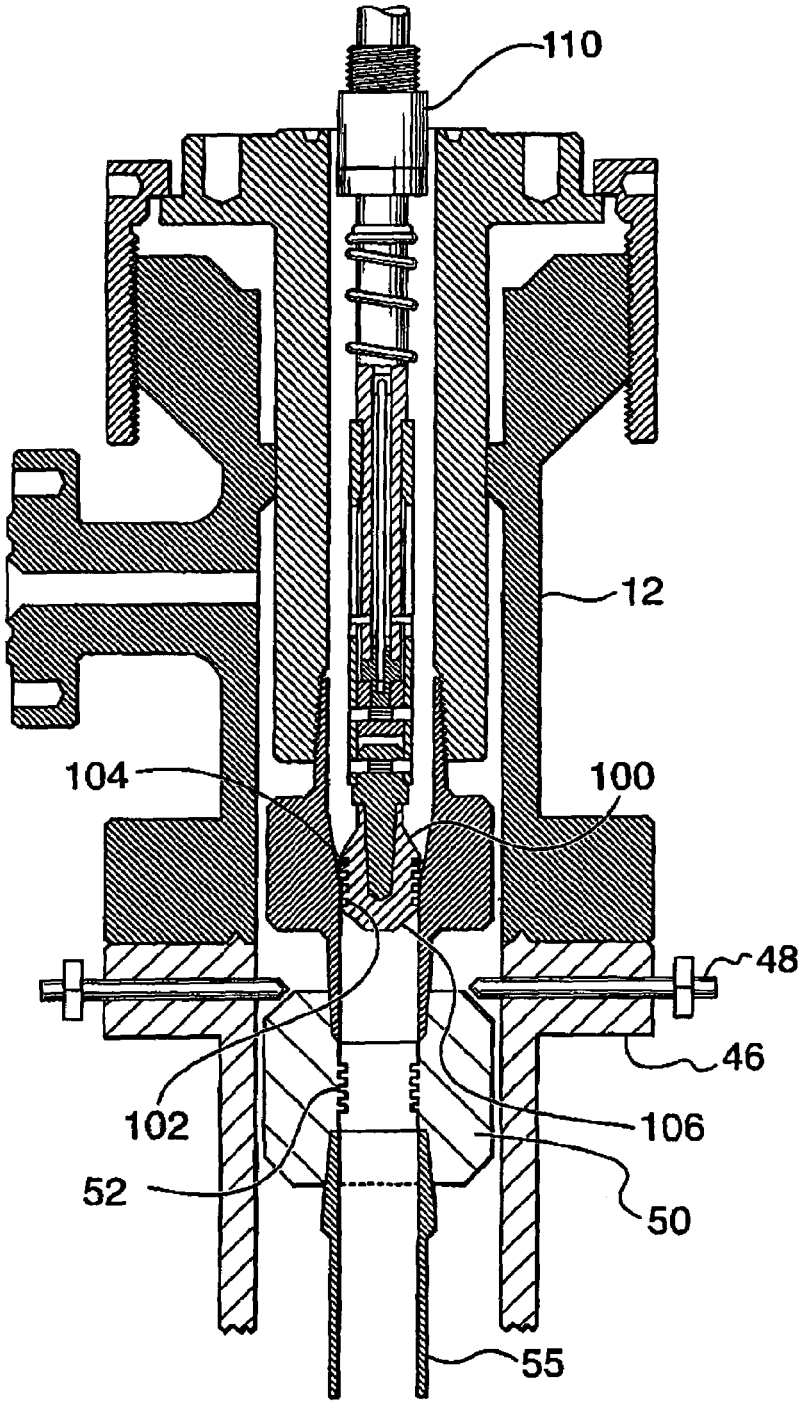
FIG. 4 is a schematic cross-sectional view showing a backpressure plug being inserted with a backpressure plug tool through the well stimulation tool.

FIG. 4 illustrates the insertion of the backpressure plug 100 using a backpressure plug tool 110. The backpressure plug 100 has pin threads 102, for engaging the backpressure threads 52 in the tubing hanger 50. An annular seal 104 provides a fluid-tight seal between the backpressure plug 100 and the tubing hanger 50. A beveled lower end 106 of the backpressure plug 100 facilitates insertion of the backpressure plug 100 through control stack equipment.

Figure 5:
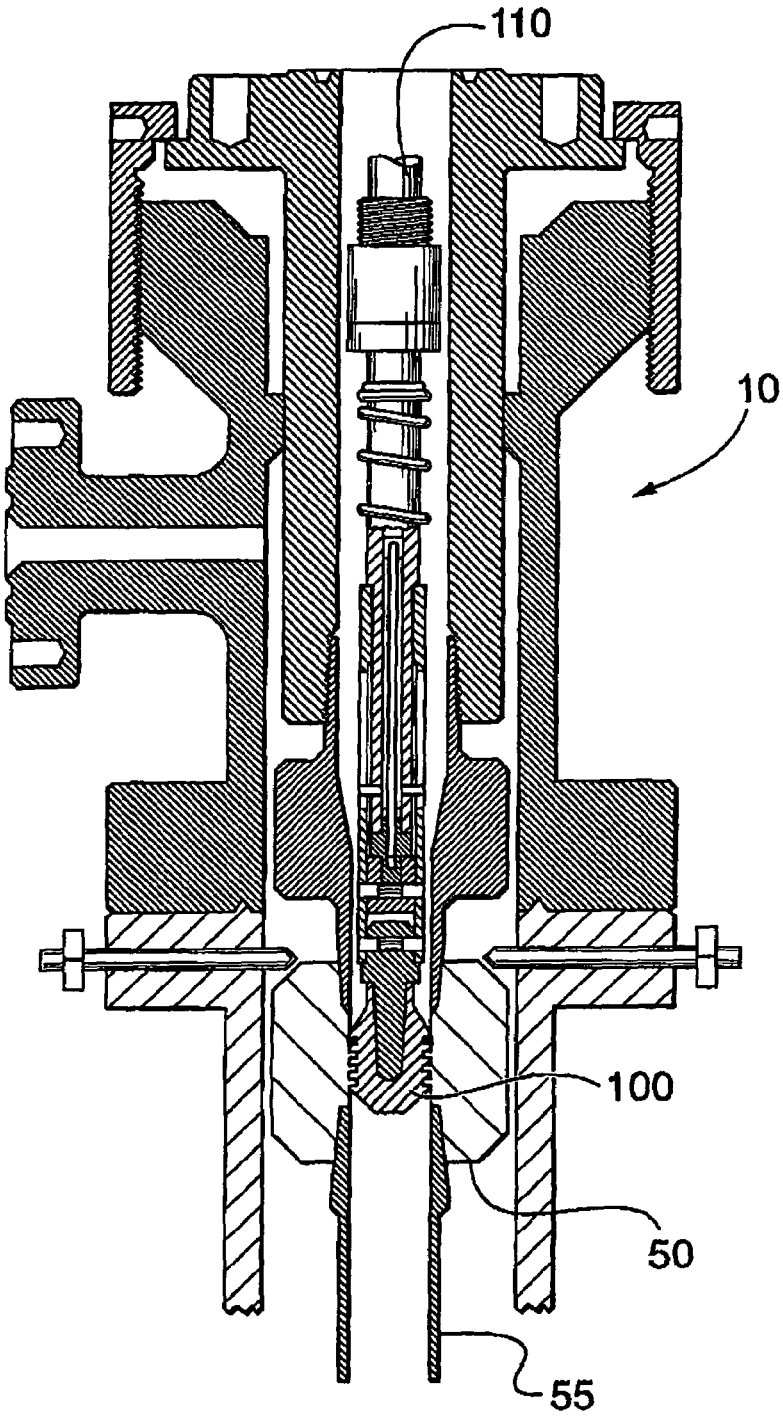
FIG. 5 is a schematic cross-sectional view of the backpressure plug being secured to backpressure threads of the tubing hanger.
Figure 6:
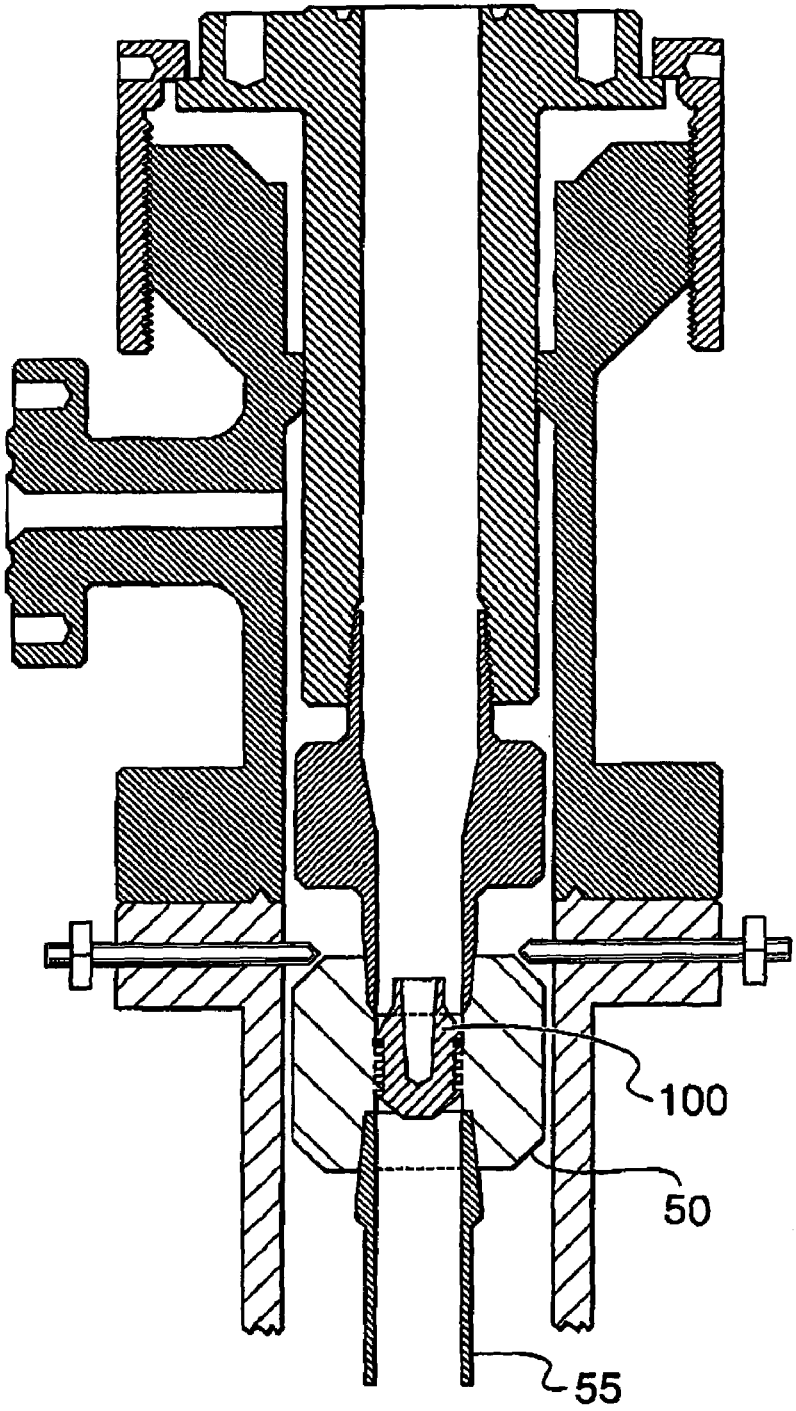
FIG. 6 is a schematic cross-sectional view of the backpressure plug sealing an axial passage through the tubing hanger.

FIG. 5 illustrates the well stimulation tool 10 after the backpressure plug 100 has been completely inserted into the tubing hanger 50. The backpressure plug 100 is secured by the pin threads 102 to the backpressure threads 52 of the tubing hanger 50. As shown in FIG. 5, the plug tool 110 and the backpressure plug 100 may be run directly through the adapter pin 20 and secured to the tubing hanger 50. The plug tool 110 is then disengaged from the backpressure plug 100 and withdrawn from the well stimulation tool 10. After withdrawal of plug tool 110, the backpressure plug 100 remains secured to the tubing hanger 50 as shown in FIG. 6. The backpressure plug thus retains the well pressure inside the production tubing 55, to permit the well stimulation tool 10 to be removed from the wellhead.

Figure 7:
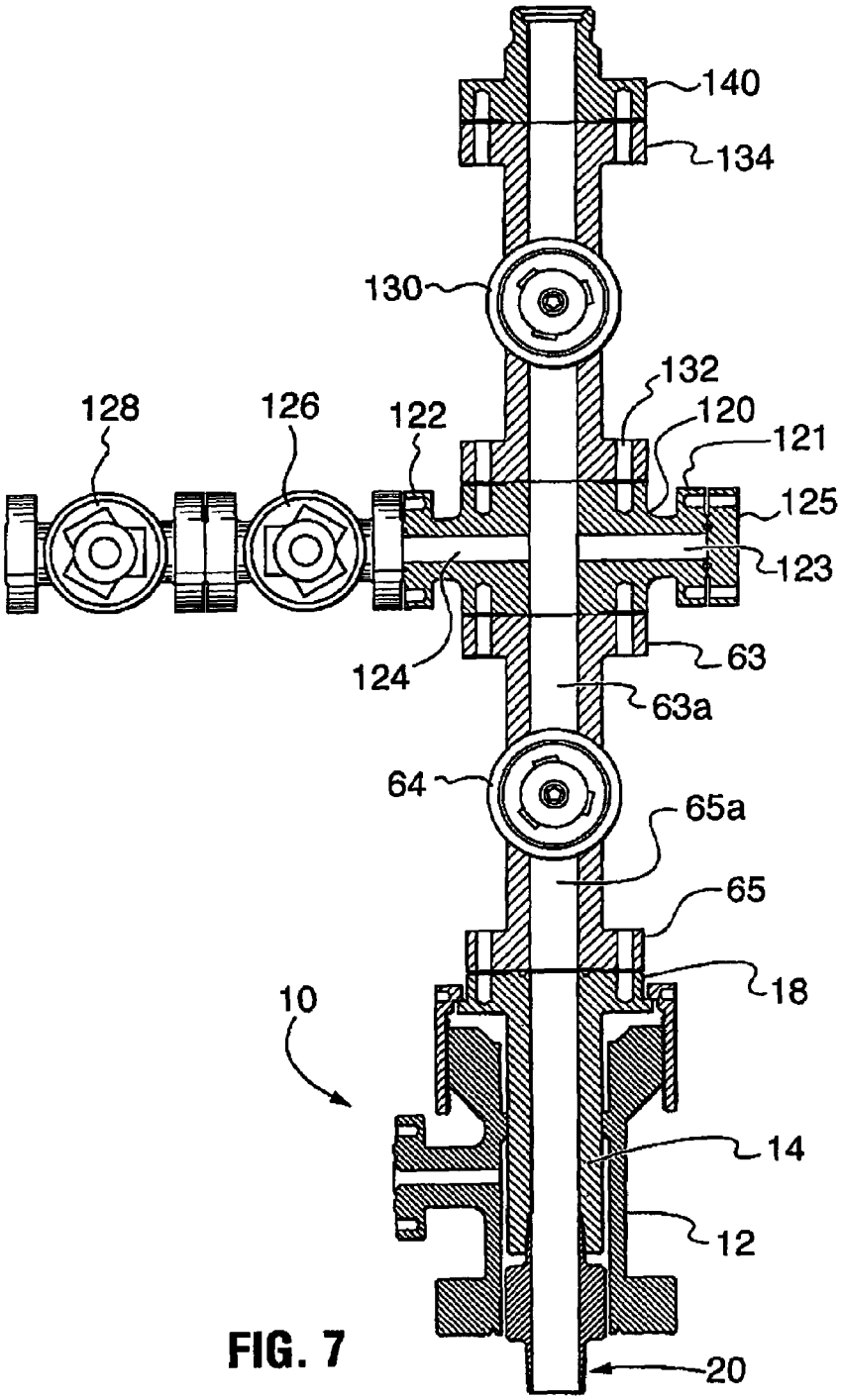
FIG. 7 is a cross-sectional view of the well stimulation tool with high-pressure valves and a flow tee.

FIG. 7 illustrates the well stimulation tool 10 equipped with a "frac stack" for fracturing or acidizing a subterranean hydrocarbon formation by injecting high-pressure fluids and/or proppants into the well. As shown in FIG. 7, the top flange 18 of the mandrel 14 is connected to a high-pressure flange 65. The high-pressure flange 65 has a high-pressure bore 65*a* which communicates with a high-pressure valve 64. The high-pressure valve 64 in turn communicates with another high-pressure bore 63*a*, which is secured at an upper flange 63 to a flow tee 120.

The flow tee 120 has a right flange 121 and a left flange 122 on right and left ends, respectively, of a right port 123 and a left port 124. In the configuration shown in FIG. 7, a cap 125 is fastened to the right port thereby sealing the right port. The left flange 122 is connected to a control valve 126 which is, in turn, connected to a backup control valve 128.

The flow tee 120 further includes a backup high-pressure valve 130 which is connected to the top of the flow tee 120 by a lower flange 132. The backup high-pressure valve 130 further includes an upper flange 134 to which a Bowen union 140 is mounted. The Bowen union 140 can be connected to a high-pressure line (not shown) for injecting high-pressure well stimulation fluids into the well to acidize and/or fracture a subterranean hydrocarbon formation.

Figure 8:
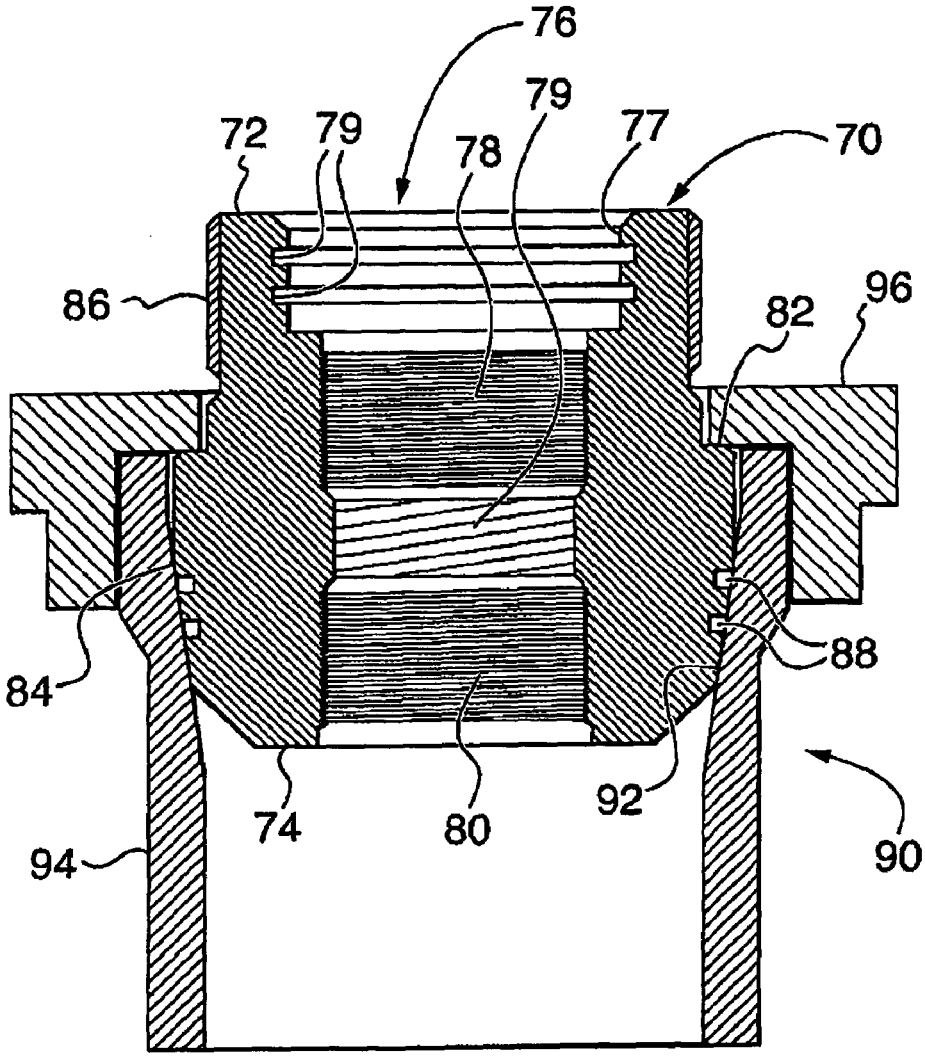
FIG. 8 is a cross-sectional view of a casing mandrel with backpressure threads for securing a backpressure plug, to permit stimulation of a live well through a production casing of the well.

As will be understood by persons skilled in the art, the invention is not limited to use with tubing hangers. The well stimulation tool in accordance with the invention can likewise be used when well stimulation fluids are to be pumped down a production casing of a live well. By way of example, FIG. 8 schematically illustrates a double-locking casing mandrel 70 seated in an independent screwed wellhead 90, as described in Applicant's co-pending U.S. patent application filed on Jul. 10, 2003 and assigned application Ser. No. 10/617099, the specification of which is incorporated herein by reference. The double-locking casing mandrel 70 includes a casing mandrel top end 72 and a casing mandrel bottom end 74, with a threaded axial passage 76 extending between the two. The threaded axial passage 76 has a diameter at least at large as an internal diameter of a casing (not shown) supported by the casing mandrel 70. A top end of the axial passage 76 includes a top end box thread 78 and a bottom end of the threaded axial passage 76 includes a bottom end box thread 80. A casing (not shown) having a complementary pin thread is threadedly connected to the casing mandrel bottom end 74, in a manner well known in the art.

The casing mandrel bottom end 74 includes a bottom exterior wall that forms an outer contour 84 shaped to mate with a contour of a casing bowl 92 formed in a cylindrical side wall 94 of the wellhead 90. The mating of the contours of the casing bowl 92 and casing mandrel 70 permits seating of the casing mandrel 70 within the wellhead 90. At least one annular groove 88 provides an annular seal retainer in the casing mandrel 70 to captively hold an elastomeric seal, such as an O-ring, to provide a fluid-tight seal between the outer contour 84 of the casing mandrel 70 and an inner surface of the casing bowl 92. The casing mandrel 70 further includes an annular shoulder 82 for supporting a casing bowl nut 96. The casing bowl nut 96 and annular shoulder 82 permit the casing mandrel 70 to be secured in the casing bowl 92.

The casing mandrel 70 further includes a pin thread 86 on an outer periphery of the casing mandrel top end 72. The pin thread 86 provides a point of attachment for a lockdown nut, permitting a well stimulation tool, or a blowout preventer, high pressure valve, or the like, to be double-locked to the casing mandrel 70. The threaded axial passage 76 includes a secondary seal bore 77 above, and coaxial with, the top end box thread 78. The secondary seal bore 77 provides at least one annular groove 79 for receiving an elastomeric O-ring seal, or the like. The secondary seal bore 77 provides a high pressure fluid-tight seal with an adapter pin (not shown), which is similar to the adapter pins described above. The axial passage 76 can be sealed using a backpressure plug (similar to the backpressure plug 100 shown and described above, but dimensioned to engage backpressure threads 79 in the axial passage 76 of the casing mandrel). The backpressure plug is secured to the backpressure threads 79 to provide a fluid-tight seal as described above in detail. The well stimulation tool in accordance with the invention permits the backpressure plug to be inserted into or removed from the casing mandrel 70 while the well stimulation tool is mounted to the casing mandrel 70, as explained above in detail.

Figure 9:
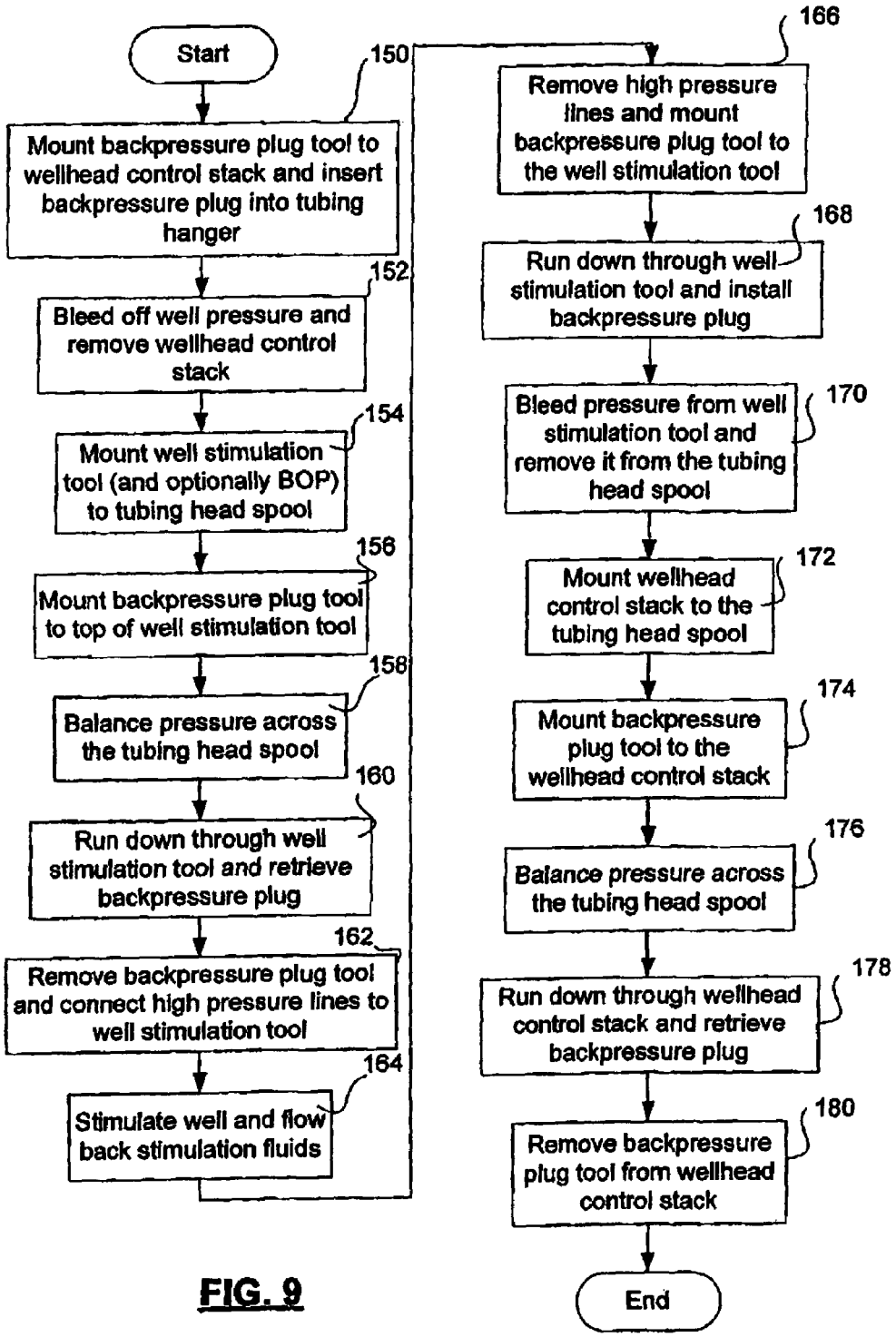
FIG. 9 is a flow chart illustrating the method in accordance with the invention.

FIG. 9 is a flow chart illustrating principle steps in performing a well stimulation procedure in accordance with the invention. The method begins at step 150 in which a backpressure plug tool is mounted to the wellhead control stack and used to insert backpressure plug 100 into the tubing hanger 50 or casing mandrel 70 of the live well. The well pressure is then bled from the control stack in a manner well known in the art, and the wellhead control stack is removed (step 152). After the wellhead control stack is removed, the top of the tubing hanger 50 or casing mandrel 70 is exposed and the well stimulation tool 10 is mounted to a top of the tubing head spool or casing mandrel in a manner well known in the art. A BOP may be mounted to a top flange of the tubing head spool or casing mandrel, in which case the well stimulation tool is mounted to the flange of the BOP (step 154).

After the well stimulation tool is mounted, the backpressure plug tool is mounted to a top of the well stimulation tool (step 156). The pressure is then balanced across the tubing head spool or casing mandrel by connecting a high pressure line between a port on the tubing head spool or wellhead and a port on the well stimulation tool in a manner well known in the art (step 158). After the pressure is balanced, the backpressure plug tool is operated to run down through the well stimulation tool and retrieve the backpressure plug 100 from the tubing hanger 50 or casing mandrel 70 (step 160). The backpressure plug tool is then removed from the top of the well stimulation tool after the appropriate valves are closed and the well pressure released from and high pressure lines are connected to the well stimulation tool (step 162). High pressure stimulation fluids are then pumped into the well.

After a given volume of fluid has been pumped or a predetermined pressure has been reached, the well stimulation fluids are removed from the well by following a procedure known as a "flow back" (step 164). The high pressure lines are then removed from the top of the well stimulation tool and the backpressure plug tool is remounted to a top of the well stimulation tool (166). The backpressure plug tool is then operated to run down through the well stimulation tool and install a backpressure plug 100 in the tubing hanger 50 or casing mandrel 70 (step 168). Once the backpressure plug 100 is installed, well pressure is bled from the well stimulation tool (step 170) and it is removed from the wellhead. The wellhead control stack is then remounted to the tubing head spool or casing mandrel (step 172). The backpressure plug tool is mounted to the wellhead control stack (step 174). The pressure is then balanced across the tubing head spool as described above (step 176). The backpressure plug tool is operated to run down through the wellhead control stack and retrieve the backpressure plug 100 from the tubing hanger 50. (Step 178). The backpressure plug tool is then removed from the wellhead control stack (step 180). Thereafter, production lines or pipe lines can be reconnected and hydrocarbon production resumed in a manner well known in the art.

As will be understood by those skilled in the art, operation of valves and/or BOP rams required in the procedure above were not explained, but are familiar to persons acquainted with well stimulation procedures.

As will be further understood by persons skilled in the art, the methods and apparatus in accordance with the invention permit the stimulation of live wells through a production tubing string or a well casing without requiring wireline services. Consequently, service costs are considerably reduced and well stimulation procedures more quickly and efficiently performed. This results in significant time and cost reductions. As will further be understood by persons skilled in the art, although the invention has been explained with reference to particular configuration of well stimulation tools invented by the applicant, the invention can be applied to any well stimulation tool adapted to be connected to box threads at a top of a central passage through a tubing hanger for supporting a production tubing string or a casing mandrel for supporting a production casing in a wellbore.

The embodiments of the invention described above are therefore intended to be exemplary only, and the scope of the invention is intended to be limited solely by the scope of the appended claims.

I claim:

1. A well stimulation tool for stimulating a well having a tubing string suspended from a tubing mandrel supported by a tubing spool of a wellhead of the well, the well stimulation tool comprising:

a well stimulation tool mandrel having an axial bore and bottom end with pin threads on an outer periphery thereof for engaging box threads in a top of a central passage through the tubing mandrel, the axial bore having a diameter larger than an outer diameter of a backpressure plug for engaging backpressure threads in the central passage to seal the central passage through the tubing mandrel to contain well pressure within the tubing string.

2. A well stimulation tool as claimed in claim 1 further comprising a plurality of adapter pins for connection to the bottom end of the well stimulation tool mandrel, to permit the well stimulation tool mandrel to be used for pumping stimulation fluids through tubing mandrels for supporting different sizes of tubing strings, the adapter pins respectively comprising a threaded top end for connection to a bottom end of the well stimulation tool mandrel, a threaded bottom end for connection to the box threads in the top of the central passage through the tubing mandrel and an axial bore having a diameter at a narrowest point that is greater than an outer diameter of a backpressure plug for the tubing mandrel to which the adapter pin is connected.

3. A well stimulation tool as claimed in claim 2 wherein the adapter pins are made of steel having a Rockwell C Hardness of greater than 30.

4. A well stimulation tool as claimed in claim 3 wherein the adapter pins are made of HH1150 stainless steel.

5. A well stimulation tool as claimed in claim 1 further comprising an adapter spool having a bottom flange for connecting to the wellhead, an annular body for receiving the well stimulation tool mandrel, and a top end having threads for engaging a lockdown nut to secure packing for providing a high pressure seal between the well stimulation tool mandrel and the adapter spool.

6. A method of mounting a well stimulation tool to a well having a wellhead which includes a tubing mandrel for supporting a tubing string in the well, comprising:

mounting a backpressure plug tool to a top of the wellhead and running the backpressure plug tool through the wellhead to secure a backpressure plug to backpressure threads in a central passage through the tubing mandrel;

bleeding well pressure from the wellhead above the tubing mandrel;

removing a control stack of the wellhead above the tubing mandrel;

mounting the well stimulation tool to the wellhead; and mounting a backpressure plug tool to a top of the well stimulation tool and running the backpressure plug tool through the well stimulation tool to remove the backpressure plug to permit stimulation fluids to be pumped into the well.

7. The method as claimed in claim 6 further comprising:

equalizing well pressure across the tubing mandrel after the backpressure plug tool is mounted to a top of the well stimulation tool, and before the backpressure plug tool is run through the well stimulation tool to remove the backpressure plug from the tubing mandrel.

8. The method as claimed in claim 7 further comprising:

removing the backpressure plug tool from the well stimulation tool;

connecting at least one high pressure line to the well stimulation tool; and pumping high pressure fluids into the well to stimulate production from the well.

9. A method of removing a well stimulation tool from a tubing mandrel of a live well, the method comprising:

sealing a production tubing of the well by inserting a backpressure plug through a well stimulation tool mandrel of the well stimulation tool to seal a central passage through the tubing mandrel;

releasing fluid pressure from the well stimulation tool mandrel; and removing the well stimulation tool from the well.

10. A method of stimulating a well having a wellhead that includes a tubing mandrel from which a tubing string is suspended in the well, comprising:

mounting a well stimulation tool to a top of the tubing mandrel after a backpressure plug has been secured to backpressure plug threads in the tubing mandrel;

mounting a backpressure plug tool to the well stimulation tool;

balancing well pressure across the tubing mandrel;

running through a well stimulation tool mandrel of the well stimulation tool with the backpressure plug tool and retrieving the backpressure plug;

removing the backpressure plug tool from the well stimulation tool and connecting at least one high pressure line to the well stimulation tool; and pumping well stimulation fluids through the at least one high pressure line and the well stimulation tool mandrel into the well.

11. The method as claimed in claim 10 further comprising, prior to mounting the well stimulation tool to the top of the tubing mandrel, determining a diameter of the tubing string suspended in the well and choosing an adapter pin of a size required to make a connection to box threads in a top of a central passage through the tubing mandrel.

12. A well stimulation tool mandrel for a well stimulation tool having a bottom end with a pin thread on an outer periphery thereof for engaging a box thread in a top of a central passage through a tubing mandrel that supports a tubing string in a wellbore, comprising an axial bore through which well stimulation fluids are pumped to stimulate a production zone that communicates with the wellbore, the axial bore having a diameter larger than an outer diameter of a backpressure plug for engaging backpressure threads in the central passage to seal the central passage and contain well pressure in the tubing string.

13. An adapter pin for a well stimulation tool, the adapter pin being connected to a bottom end of a well stimulation tool mandrel of the well stimulation tool, the adapter pin having a bottom end with a pin thread on an outer periphery thereof for engaging a box thread in a top of a central passage through a tubing mandrel that supports a tubing string in a wellbore, the adapter pin comprising an axial bore through which well stimulation fluids are pumped to stimulate a production zone that communicates with the wellbore, the axial bore having a diameter larger than an outer diameter of a backpressure plug for engaging backpressure threads in the central passage to seal the central passage and contain well pressure in the tubing string.

14. A well stimulation tool mandrel and an adapter pin, in combination, for a well stimulation tool, the adapter pin being connected to a bottom end of the well stimulation tool mandrel and having a bottom end with a pin thread on an outer periphery thereof for engaging a box thread in a top of a central passage through a tubing mandrel that supports a tubing string in a wellbore, the well stimulation tool mandrel and the adapter pin respectively comprising an axial bore through which well stimulation fluids are pumped to stimulate a production zone that communicates with the wellbore, the axial bores having respective diameters larger than an outer diameter of a backpressure plug for engaging backpressure threads in the central passage to seal the central passage to contain well pressure within the tubing string.

15. A method of sealing a tubing string of a well after a production zone that communicates with a wellbore of the well has been stimulated by pumping high pressure fluids through a well stimulation tool connected to a tubing mandrel that suspends the tubing string in the well, comprising running a backpressure plug through the well stimulation tool and securing the backpressure plug to backpressure plug threads in a central passage through the tubing mandrel.

16. The method as claimed in claim 15 further comprising:

determining a diameter of the tubing string suspended in the well and choosing an adapter pin of a size required to make a connection to box threads in a top of the central passage through the tubing mandrel; and connecting the adapter pin to a bottom of a well stimulation tool mandrel of the well stimulation tool.

17. The method as claimed in claim 15 further comprising removing the well stimulation tool from a wellhead of the well.

18. The method as claimed in claim 17 further comprising re-mounting a control stack to the wellhead of the well.

19. The method as claimed in claim 18 further comprising mounting a backpressure plug tool to a top of the control stack of the well.

20. The method as claimed in claim 19 further comprising using the backpressure plug tool to remove the backpressure plug from the central passage through the control stack of the well.

* * * * *